US008058808B2

(12) United States Patent
Hong et al.

(10) Patent No.: US 8,058,808 B2
(45) Date of Patent: Nov. 15, 2011

(54) LIGHT EMITTING DISPLAY DEVICE AND DRIVING METHOD THEREOF

(75) Inventors: Soon Kwang Hong, Daegu-si (KR); Chang Hoon Jeon, Gyeongsangbuk-do (KR)

(73) Assignee: LG. Display Co. Ltd., Seoul (KR)

( * ) Notice: Subject to any disclaimer, the term of this patent is extended or adjusted under 35 U.S.C. 154(b) by 698 days.

(21) Appl. No.: 12/169,851

(22) Filed: Jul. 9, 2008

(65) Prior Publication Data

US 2009/0206770 A1 Aug. 20, 2009

(30) Foreign Application Priority Data

Jul. 9, 2007 (KR) ..... 10-2007-0068758

(51) Int. Cl.
*G09G 3/10* (2006.01)

(52) U.S. Cl. ..... 315/169.3; 345/77

(58) Field of Classification Search ..... 315/160, 315/167, 169.3; 345/45, 55, 76, 77, 78, 82, 345/84, 204, 205, 214
See application file for complete search history.

(56) References Cited

U.S. PATENT DOCUMENTS

| | | | | |
|---|---|---|---|---|
| 7,164,401 | B2 * | 1/2007 | Kwon | 345/82 |
| 7,911,427 | B2 * | 3/2011 | Chung et al. | 345/82 |
| 2005/0140600 | A1 * | 6/2005 | Kim et al. | 345/76 |
| 2007/0024541 | A1 * | 2/2007 | Ryu et al. | 345/76 |

* cited by examiner

*Primary Examiner* — Thuy Vinh Tran
(74) *Attorney, Agent, or Firm* — Brinks Hofer Gilson & Lione

(57) ABSTRACT

Disclosed herein are a light emitting display device which can reduce hysteresis of a driving transistor to improve picture quality, and a method for driving the same. The device includes a pixel cell formed in an area defined by a data line supplied with a data voltage, at least one scan line supplied with a scan signal, a light emission control signal line supplied with a light emission control signal, a driving voltage line supplied with a driving voltage, and a compensation voltage line supplied with a compensation voltage of a first voltage level or a second voltage level different from the first voltage level. The pixel cell includes a light emitting element for emitting light by current, and a pixel circuit for providing current corresponding to the data voltage to the light emitting element using the data voltage, scan signal, light emission control signal, driving voltage and compensation voltage.

12 Claims, 11 Drawing Sheets

LIGHT EMITTING DISPLAY DEVICE AND DRIVING METHOD THEREOF

This application claims the benefit of Korean Patent Application No. 10-2007-0068758, filed on Jul. 9, 2007 which is hereby incorporated by reference as if fully set forth herein.

BACKGROUND OF THE INVENTION

1. Field of the Invention

The present invention relates to a light emitting display device, and more particularly, to a light emitting display device which is capable of reducing hysteresis of a driving transistor to improve picture quality, and a method for driving the same.

2. Discussion of the Related Art

Recently, various flat panel display devices which are small in volume and weight compared with a cathode ray tube have been developed, and a light emitting display device using a light emitting element which has a high luminous efficiency, excellent brightness, wide viewing angle and high response speed, among the flat panel display devices, has been especially highlighted.

The light emitting element has a structure where a light emitting layer, which is a thin film emitting light, is disposed between a cathode electrode and an anode electrode, and a characteristic where excitons are generated in the light emitting layer by injecting electrons and holes into the light emitting layer and recombining them therein and light is emitted from the light emitting layer when the generated excitons falls to their low energy states. Such light emitting elements are classified into an inorganic light emitting element and an organic light emitting element according to materials of the light emitting layer.

FIG. 1 is a circuit diagram of a pixel cell of a general light emitting display device.

Referring to FIG. 1, the pixel cell of the general light emitting display device, denoted by reference numeral 10, includes a pixel circuit 12 and a light emitting element 14 formed in an area defined by a data line DLm, a scan line SLn and a driving voltage line PL.

A data voltage is supplied to the data line DLm, and a scan signal is supplied to the scan line SLn. Also, a driving voltage of a constant level is supplied to the driving voltage line PL.

The pixel circuit 12 includes a switching element ST, a driving transistor DT, and a capacitor Cst. Here, the switching element ST and driving transistor DT are p-channel (or P-type) metal oxide semiconductor (PMOS) transistors.

The switching element ST supplies the data voltage from the data line DLm to a first node N1 in response to the scan signal supplied to the scan line SLn.

The driving transistor DT supplies current corresponding to the data voltage supplied to the first node N1 to the light emitting element 14 using the driving voltage supplied to the driving voltage line PL.

The capacitor Cst stores a voltage corresponding to the data voltage supplied to the first node N1, and then holds an ON state of the driving transistor DT for a period of one frame when the switching element ST is turned off.

The light emitting element 14 emits light by the current corresponding to the data voltage, supplied from the driving voltage line PL via the driving transistor DT. At this time, current I flowing to the light emitting element 14 can be expressed by the following equation 1:

$$I=\beta/2(Vgs-Vth)^2=\beta/2(V\text{data}-Vdd-Vth)^2 \quad \text{[Equation 1]}$$

In the equation 1, I represents the current flowing to the light emitting element 14, Vgs represents a gate-source voltage of the driving transistor DT, Vth represents a threshold voltage of the driving transistor DT, Vdata represents the data voltage, and β represents a constant.

In the general light emitting display device as mentioned above, the current as in the equation 1 is supplied to the light emitting element 14 by the pixel circuit 12 to turn on the light emitting element 14 so as to display an image.

However, in this general light emitting display device, a negative data voltage is always applied to the gate electrode of the driving transistor DT through the switching element ST, so that the gate-source voltage of the driving transistor ST is always negative. As a result, the hysteresis of the driving transistor DT increases as shown in FIG. 2, resulting in a problem that the current corresponding to the data voltage cannot be supplied to the light emitting element 14 as it is.

In detail, a first curve C1 can be obtained by measuring source-drain current Ids of the driving transistor DT while varying the gate voltage of the driving transistor DT having hysteresis from a low voltage to a high voltage. Also, a second curve C2 can be obtained by measuring the source-drain current Ids of the driving transistor DT while varying the gate voltage of the driving transistor DT having hysteresis from a high voltage to a low voltage. As a result, the general light emitting display device is problematic in that the threshold voltage Vth of the driving transistor DT is subject to a variation ΔVth due to the hysteresis of the driving transistor DT.

FIG. 3A shows a display state of an image of a chess pattern in the general light emitting display device, and FIG. 3B shows a display state of an image of the same gray scale pattern in the general light emitting display device immediately after the image of the chess pattern is displayed in the display device.

A degradation in picture quality due to the hysteresis of the driving transistor DT will hereinafter be described with reference to FIGS. 3A and 3B in association with FIG. 2.

When the image of the chess pattern shown in FIG. 3A is displayed in the light emitting display device, white areas A and black areas B are displayed on a display panel of the light emitting display device. At this time, a white data voltage is applied to the gate electrode of each driving transistor DT formed in each white area A, and a black data voltage is applied to the gate electrode of each driving transistor DT formed in each black area B.

When the image of the same gray scale pattern is displayed on the display panel of the light emitting display device immediately after the image of the chess pattern is displayed on the display panel, it is ideal that a gray scale image of the same brightness is supposed to be displayed on the entire screen of the display panel.

However, in the case where the driving transistor DT of the light emitting display device has hysteresis, each driving transistor DT formed in each white area A and each driving transistor DT formed in each black area B have different threshold voltages Vth, thereby causing each light emitting element 14 in each white area A and each light emitting element 14 in each black area B to display different brightnesses. That is, as shown in FIG. 3B, when the image of the same gray scale pattern is displayed on the display panel immediately after the image of the chess pattern is displayed on the display panel, brightness C of a gray scale pattern displayed in each white area A is displayed more darkly than brightness D of a gray scale pattern displayed in each black area B.

In conclusion, the general light emitting display device has a disadvantage in that picture quality is degraded due to an afterimage formed as the image of the same gray scale is displayed with a different brightness value because of an increase in the hysteresis of the driving transistor.

SUMMARY OF THE INVENTION

Accordingly, the present invention is directed to a light emitting display device and a driving method thereof that substantially obviate one or more problems due to limitations and disadvantages of the related art.

An object of the present invention is to provide a light emitting display device which is capable of reducing hysteresis of a driving transistor to improve picture quality, and a method for driving the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a light emitting display device comprises a pixel cell formed in an area defined by a data line supplied with a data voltage, at least one scan line supplied with a scan signal, a light emission control signal line supplied with a light emission control signal, a driving voltage line supplied with a driving voltage, and a compensation voltage line supplied with a compensation voltage of a first voltage level or a second voltage level different from the first voltage level, wherein the pixel cell comprises: a light emitting element for emitting light by current; and a pixel circuit for providing current corresponding to the data voltage to the light emitting element using the data voltage, the scan signal, the light emission control signal, the driving voltage and the compensation voltage.

In another aspect of the present invention, a light emitting display device comprises a pixel cell formed in an area defined by a data line supplied with a data voltage, at least one scan line supplied with a scan signal, a light emission control signal line supplied with a light emission control signal, a driving voltage line supplied with a driving voltage, and a compensation voltage line supplied with a compensation voltage of a first voltage level or a second voltage level different from the first voltage level, wherein the pixel cell comprises: a light emitting element for emitting light by current; and a pixel circuit for providing current corresponding to the data voltage to the light emitting element based on the data voltage, the scan signal, the light emission control signal, the driving voltage and the compensation voltage of the first voltage level and turning off the light emitting element based on the compensation voltage of the second voltage level.

In a further aspect of the present invention, a method for driving a light emitting display device, where the light emitting display device includes a pixel cell formed in an area defined by a data line supplied with a data voltage, at least one scan line supplied with a scan signal, a light emission control signal line supplied with a light emission control signal, a driving voltage line supplied with a driving voltage, and a compensation voltage line supplied with a compensation voltage, comprises: supplying the compensation voltage of a first voltage level to the compensation voltage line; outputting current corresponding to the data voltage based on the data voltage, the scan signal, the light emission control signal, the driving voltage and the compensation voltage of the first voltage level; turning on a light emitting element by the current; and supplying the compensation voltage of a second voltage level different from the first voltage level to the compensation voltage line to turn off the light emitting element.

The first voltage level may be supplied in a first period of a frame and the second voltage level may be supplied in a second period of the frame, the second period being a remaining period of the frame other than the first period.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts. In the following description of the present invention, a detailed description of known functions and configurations incorporated herein will be omitted when it may make the subject matter of the invention rather unclear.

Figure 1:
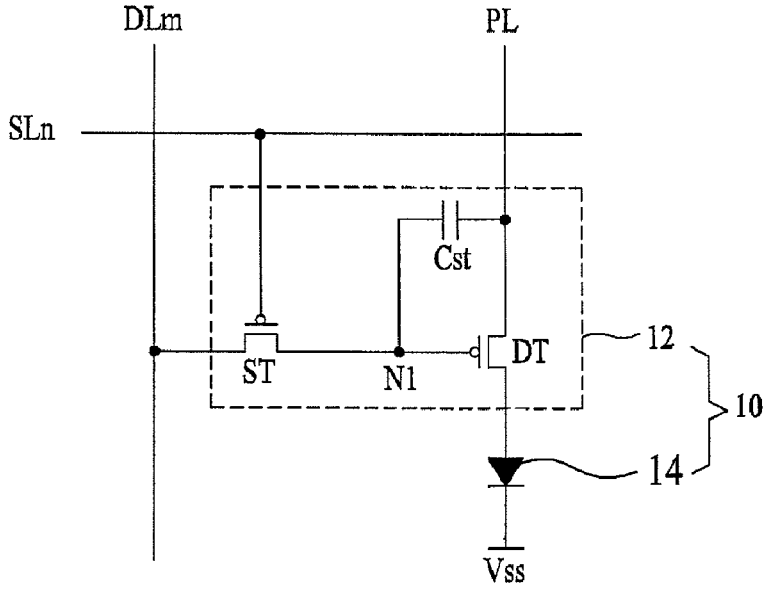
FIG. 1 Related Art
FIG. 1 is a circuit diagram of a pixel cell of a general light emitting display device.
Figure 2:
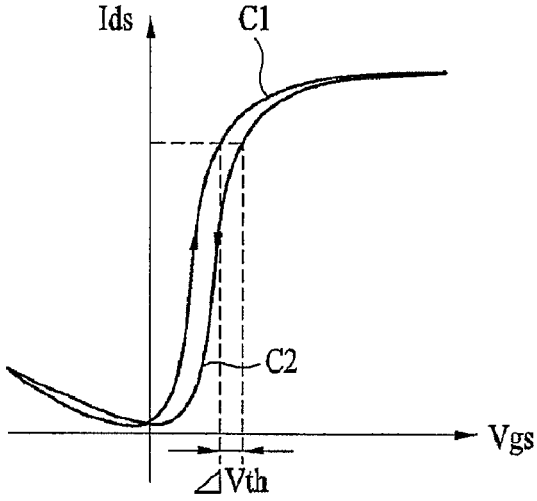
FIG. 2 Related Art
FIG. 2 is a graph illustrating hysteresis of a driving transistor shown in FIG. 1.
Figure 3A:
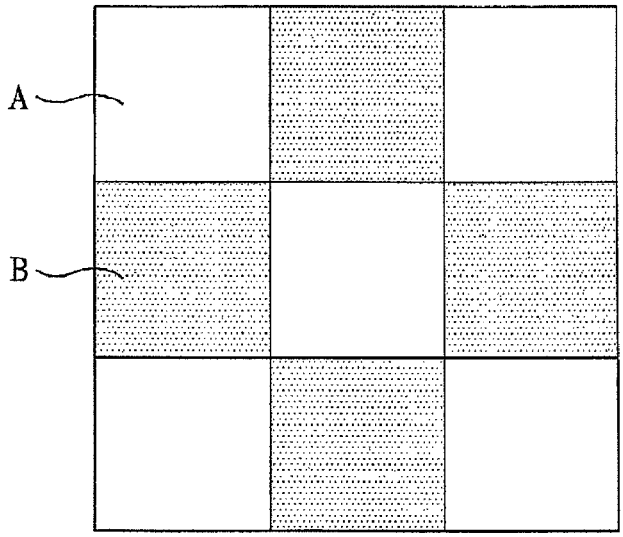
FIG. 3A Related Art
FIG. 3A is a view showing a display state of an image of a chess pattern in the general light emitting display device.
Figure 3B:
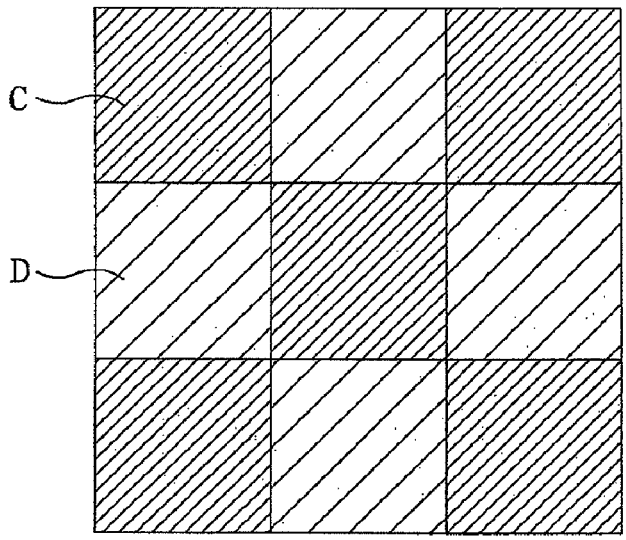
FIG. 3B Related Art
FIG. 3B is a view showing a display state of an image of the same gray scale pattern in the general light emitting display device immediately after the image of the chess pattern is displayed in the display device.
Figure 4:
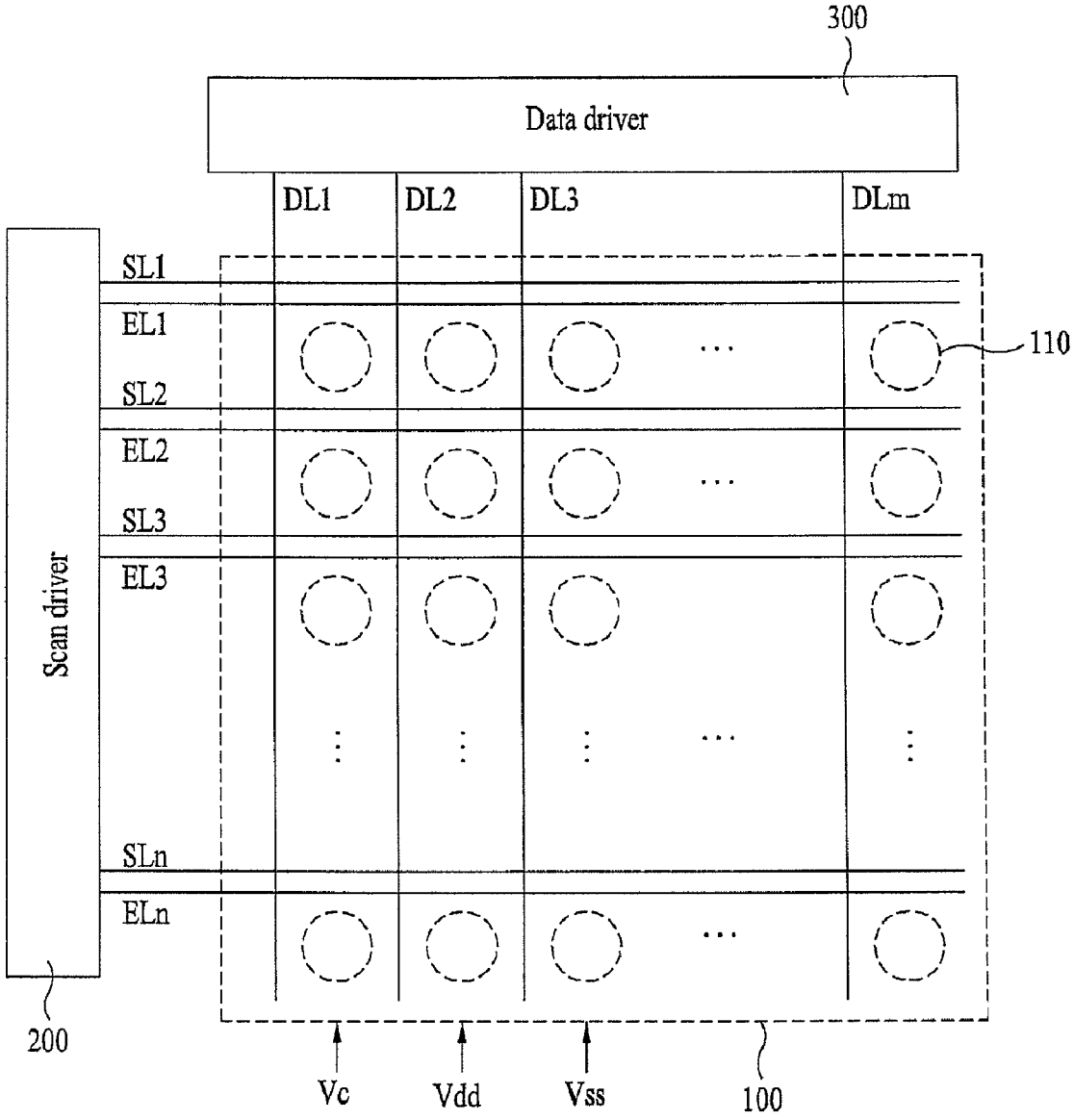
FIG. 4 is a schematic view of a light emitting display device according to a first embodiment of the present invention.

FIG. 4 is a schematic view of a light emitting display device according to a first embodiment of the present invention.

Referring to FIG. 4, the light emitting display device according to the first embodiment of the present invention comprises a display panel 100 including a plurality of pixel cells 110 formed respectively in areas defined by m (where m is a natural number) data lines DL1 to DLm each supplied with a data voltage, n (where n is a natural number different from m) scan lines SL1 to SLn each supplied with a scan signal, n light emission control signal lines EL1 to ELn each supplied with a light emission control signal, a driving voltage line (not shown) supplied with a driving voltage Vdd, and a compensation voltage line (not shown) supplied with a compensation voltage Vc of a first voltage level or a second voltage level different from the first voltage level, a scan driver 200 for driving the scan lines SL1 to SLn and the light emission control signal lines EL1 to ELn, and a data driver 300 for supplying the data voltage to each of the data lines DL1 to DLm.

The scan driver 200 generates the scan signal using a start pulse and a clock signal, not shown, and sequentially supplies the generated scan signal to the scan lines SL1 to SLn. Also, the scan driver 200 generates the light emission control signal using the start pulse and clock signal or the scan signal and sequentially supplies the generated light emission control signal to the light emission control signal lines EL1 to ELn. At this time, the scan signal and the light emission control signal have forms contrary to each other.

The data driver 300 generates the data voltage in response to data control signals, not shown, and supplies the generated data voltage to each of the data lines DL1 to DLm. At this time, the data driver 300 supplies a data voltage of one horizontal line to each of the data lines DL1 to DLm in every one horizontal period.

The driving voltage Vdd, which has a constant voltage level, is supplied to the driving voltage line.

The compensation voltage Vc of the first voltage level is supplied to the compensation voltage line in a first period of each frame, and the compensation voltage Vc of the second voltage level different from the first voltage level is supplied to the compensation voltage line in a second period of each frame, which is the remaining period of each frame other than the first period. Here, the first period in which the compensation voltage Vc of the first voltage level is supplied may be, for example, a period from immediately after the scan signal is supplied to the first scan line SL1 until the scan signal is supplied to the last scan line SLn, and the second period in which the compensation voltage Vc of the second voltage level is supplied may be, for example, a period from immediately after the scan signal is supplied to the last scan line SLn until the scan signal is supplied to the first scan line SL1. On the other hand, the compensation voltage Vc of the second voltage level may be supplied every two or more frames.

The first voltage level of the compensation voltage Vc is the same as the voltage level of the driving voltage Vdd. The second voltage level of the compensation voltage Vc corresponds to a black data voltage, or is higher than the voltage level of the driving voltage Vdd when a driving transistor DT is a p-channel metal oxide semiconductor (PMOS) transistor and lower than the voltage level of the driving voltage Vdd when the driving transistor DT is an n-channel (or n-type) metal oxide semiconductor (NMOS) transistor.

The compensation voltage Vc of the first voltage level is provided to compensate for a threshold voltage of the driving transistor DT, and the compensation voltage Vc of the second voltage level is provided to reduce hysteresis of the driving transistor DT to prevent a variation in the threshold voltage of the driving transistor DT.

Figure 5:
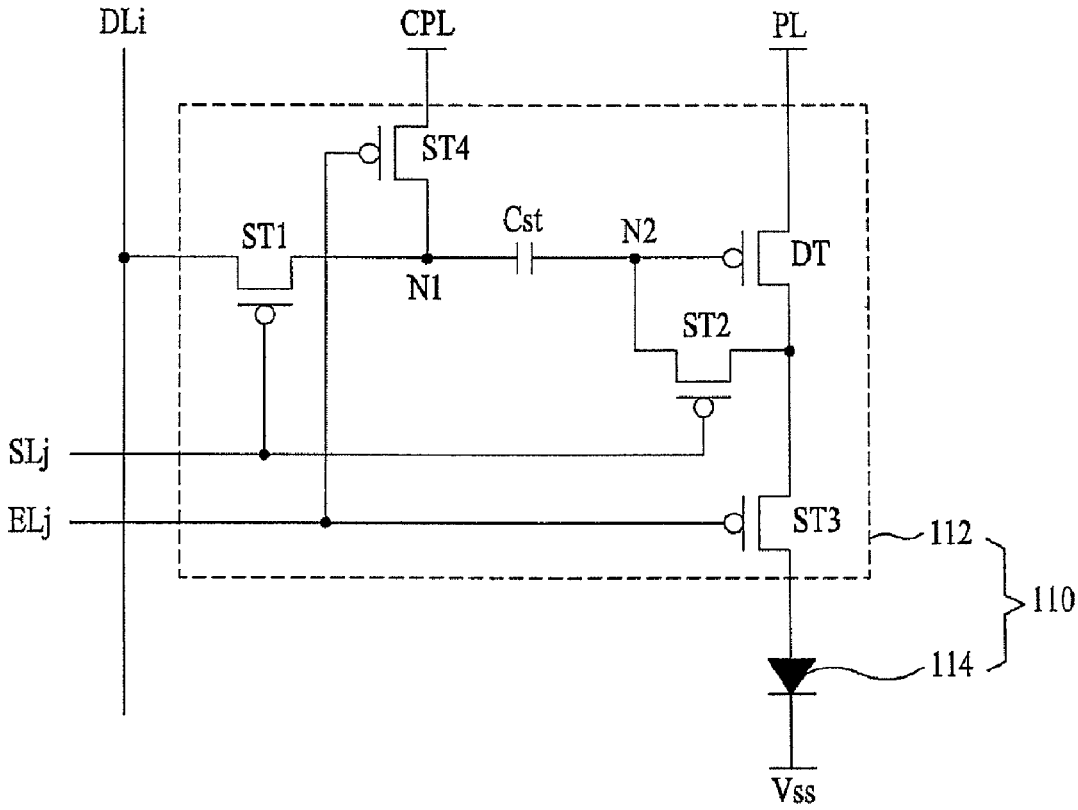
FIG. 5 is a circuit diagram showing a pixel structure of a pixel cell according to the first embodiment of the present invention, shown in FIG. 4.

FIG. 5 is a circuit diagram showing a pixel structure of a pixel cell 110 connected to an ith (where i is a natural number which is any one of 1 to m) data line DLi, a jth (where j is a natural number which is any one of 1 to n) scan line SLj, and a jth light emission control signal line ELj, among the plurality of pixel cells shown in FIG. 4.

Referring to FIG. 5 in association with FIG. 4, the pixel cell 110 includes a pixel circuit 112 for outputting current corresponding to the data voltage using the scan signal, light emission control signal, driving voltage Vdd and compensation voltage Vc, and a light emitting element 114 for emitting light by the current from the pixel circuit 112.

The pixel circuit 112 includes a driving transistor DT, first to fourth switching elements ST1 to ST4, and a capacitor Cst. Here, the driving transistor DT and the first to fourth switching elements ST1 to ST4 are PMOS transistors.

The driving transistor DT outputs the current corresponding to the data voltage supplied to the gate electrode thereof using the driving voltage Vdd supplied from the driving voltage line, denoted by the reference character PL.

The first switching element ST1 supplies the data voltage supplied to the data line DLi to a first node N1 in response to the scan signal supplied to the scan line SLj.

The second switching element ST2 interconnects the gate electrode and drain electrode of the driving transistor DT in response to the scan signal supplied to the scan line SLj to connect the driving transistor DT in the form of a diode.

The third switching element ST3 connects the drain electrode of the driving transistor DT to the anode electrode of the light emitting element 114 in response to the light emission control signal supplied to the light emission control signal line ELj. That is, the third switching element ST3 supplies the current outputted from the driving transistor DT to the light emitting element 114 in response to the light emission control signal.

The fourth switching element ST4 supplies the compensation voltage Vc of the first voltage level or the second voltage level different from the first voltage level, supplied from the compensation voltage line, denoted by the reference character CPL, to the first node N1 in response to the light emission control signal supplied to the light emission control signal line ELj.

The capacitor Cst has a first terminal connected to the first node N1, and a second terminal connected to a second node N2, which is the gate electrode of the driving transistor DT. This capacitor Cst stores a difference voltage between the first node N1 and the second node N2, and then keeps the driving transistor DT on for a period of one frame using the stored voltage when the first switching element ST1 is turned off.

The light emitting element 114 has an anode electrode connected to the third switching element ST3, a cathode electrode connected to a common voltage line Vss, and a light emitting layer (not shown) formed between the anode electrode and the cathode electrode. The light emitting layer may be an organic light emitting layer or an inorganic light emitting layer. This light emitting element 114 emits light by the current supplied through the third switching element ST3 from the driving transistor DT.

Figure 6A:
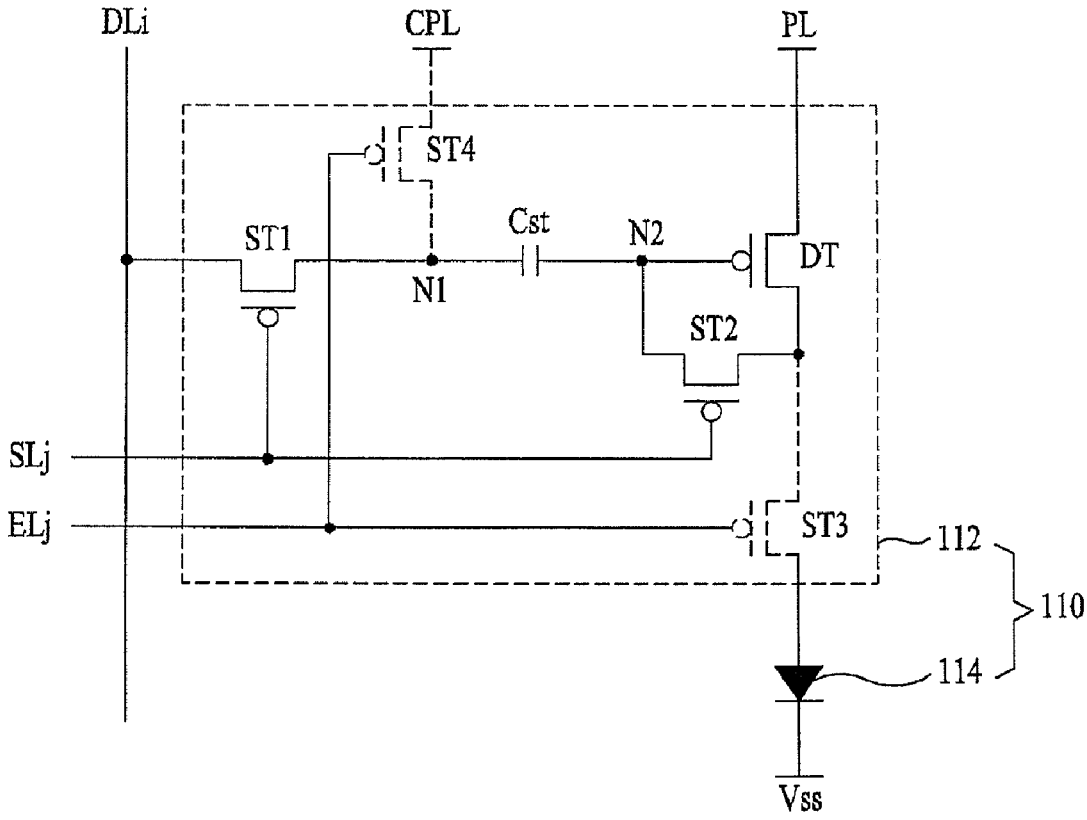
FIGS. 6A and 6B are circuit diagrams stepwise illustrating the operation of the pixel cell shown in FIG. 5.
Figure 6B:
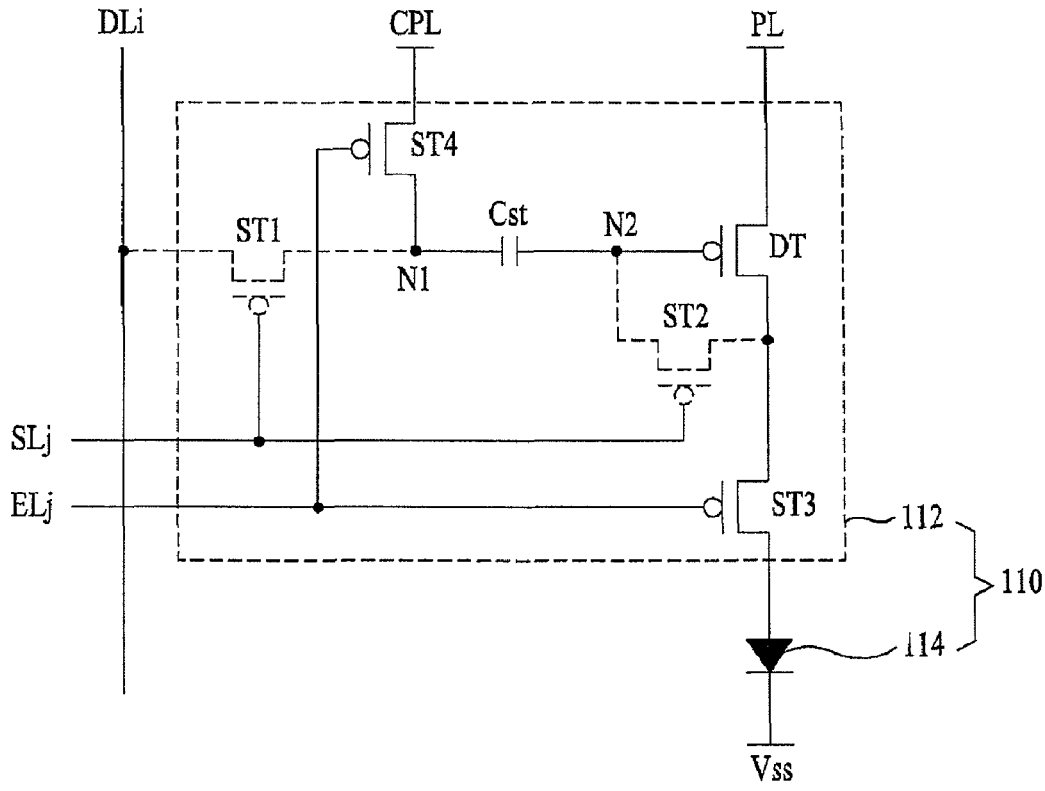

FIGS. 6A and 6B are circuit diagrams stepwise illustrating the operation of the pixel cell 110 shown in FIG. 5.

First, in order to compensate for a threshold voltage Vth of the driving transistor DT, sampling is carried out with respect to the threshold voltage Vth of the driving transistor DT. Here, Vth_S means a sampled threshold voltage Vth of the driving transistor DT.

To this end, the light emission control signal of a high state is supplied to the light emission control signal line ELj at the same time that the scan signal of a low state is supplied to the scan line SLj. The data voltage is supplied to the data line DLi synchronously with the scan signal. Also, the compensation voltage Vc of the first voltage level is supplied to the compensation voltage line CPL.

As a result, as shown in FIG. 6A, each of the first and second switching elements ST1 and ST2 is turned on and each of the third and fourth switching elements ST3 and ST4 is turned off. Consequently, the data voltage is supplied to the first node N1, and the threshold voltage Vth of the driving transistor DT is supplied to the second node N2 by the turning-on of the second switching element ST2, so that the threshold voltage Vth of the driving transistor DT is sampled at the second node N2. At this time, because the driving voltage Vdd is supplied to the source electrode of the driving transistor DT, a voltage $V_{N2}$ at the second node N2 can be expressed as in the following equation 2:

$$V_{N2}=Vdd-|Vth_S| \quad \text{[Equation 2]}$$

Thereafter, the light emission control signal of a low state is supplied to the light emission control signal line ELj at the same time that the scan signal of a high state is supplied to the scan line SLj.

As a result, as shown in FIG. 6B, each of the first and second switching elements ST1 and ST2 is turned off and each of the third and fourth switching elements ST3 and ST4 is turned on. Consequently, the compensation voltage Vc of the first voltage level is supplied to the first node N1 through the fourth switching element ST4, so that a voltage variation $\Delta V_{N1}$ at the first node N1 can be expressed as in the following equation 3:

$$\Delta V_{N1}=Vc-V\text{data} \quad \text{[Equation 3]}$$

Also, because no current path is formed in the pixel circuit 112, a voltage across the capacitor Cst is kept constant. As a result, the voltage at the second node N2 varies by the voltage variation $\Delta V_{N1}$ at the first node N1 as in the following equation 4:

$$V_{N2}=Vdd-|Vth_S|+\Delta V_{N1}=Vdd-|Vth_S|+Vc-V\text{data} \quad \text{[Equation 4]}$$

Then, the driving transistor DT is turned on by a gate-source voltage Vgs thereof. Thus, current I which is supplied from the driving transistor DT to the light emitting element 114 through the third switching element ST3 can be expressed by the following equation 5:

$$\begin{aligned} I &= \beta/2(Vgs-\text{Vth_R})^2 \quad \text{[Equation 5]} \\ &= \beta/2(Vdd-|\text{Vth_S}|+Vc-Vdata-Vdd-\text{Vth_R})^2 \\ &= \beta/2(Vc-Vdata-|\text{Vth_S}|-\text{Vth_R})^2 \end{aligned}$$

In the equation 5, Vth_R means a real threshold voltage of the driving transistor DT, and β represents a constant.

If the sampled threshold voltage Vth_S of the driving transistor DT and the real threshold voltage Vth_R of the driving transistor DT are the same in the equation 5, the current I outputted from the driving transistor DT is determined depending on the compensation voltage Vc and the data voltage under no influence of a voltage drop IR-Drop on the driving voltage line PL and the threshold voltage Vth of the driving transistor DT. Therefore, a degradation in picture quality resulting from hysteresis of the driving transistor DT is minimized.

On the other hand, if the sampled threshold voltage Vth_S of the driving transistor DT and the real threshold voltage Vth_R of the driving transistor DT are different from each other, the current I outputted from the driving transistor DT is influenced by the sampled threshold voltage Vth_S of the driving transistor DT and the real threshold voltage Vth_R of the driving transistor DT. In this case, because the hysteresis of the driving transistor DT increases, there is a problem that picture quality is degraded due to an afterimage.

However, in the present invention, the compensation voltage Vc of the second voltage level is supplied to the compensation voltage line CPL in the second period of each frame to prevent the hysteresis of the driving transistor DT from increasing, so as to prevent picture quality from being degraded due to an afterimage.

Figure 7:
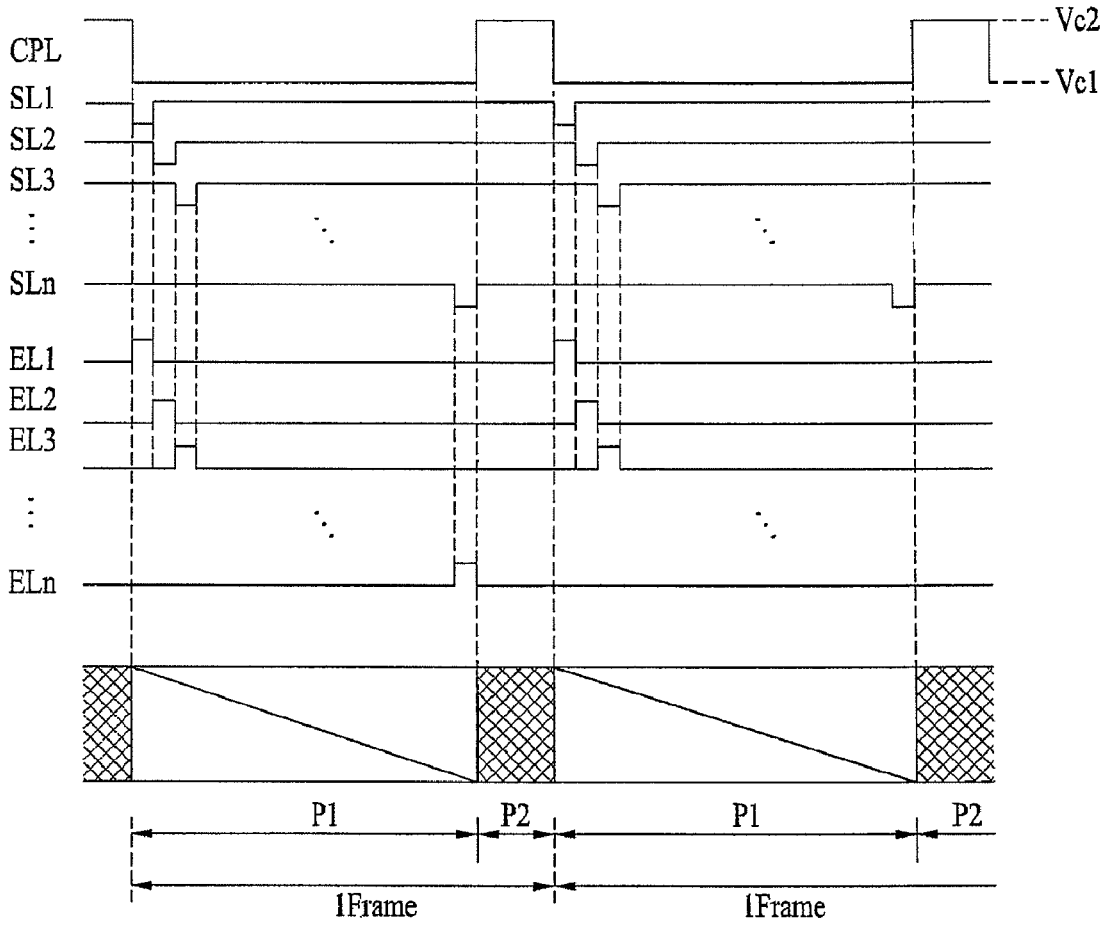
FIG. 7 is a driving waveform diagram of the light emitting display device according to the first embodiment of the present invention.

FIG. 7 is a driving waveform diagram of the light emitting display device according to the first embodiment of the present invention. The driving of the light emitting display device according to the first embodiment of the present invention will hereinafter be described in detail with reference to FIG. 7 in association with FIG. 5.

First, as stated previously with reference to FIGS. 6A and 6B, the compensation voltage (denoted by Vc1) of the first voltage level is supplied to the compensation voltage line CPL in the period P1 of each frame. Then, the light emission control signal of a high state is sequentially supplied to the light emission control signal lines EL1 to ELn at the same time that the scan signal of a low state is sequentially supplied to the scan lines SL1 to SLn. Also, the data voltage is supplied to each of the data lines DL1 to DLm synchronously with the scan signal. As a result, each pixel circuit 112 is driven by the scan signal, light emission control signal, data voltage, compensation voltage Vc1 and driving voltage Vdd to supply the current I corresponding to the aforementioned equation 5 to each light emitting element 114 so as to turn on each light emitting element 114.

Thereafter, the compensation voltage Vc2 of the second voltage level is supplied to the compensation voltage line CPL in the second period P2 of the each frame. As a result, the compensation voltage Vc2 of the second voltage level is supplied to the first node N1 through the fourth switching element ST4, so that the voltage at the second node N2 varies by a voltage variation at the first node N1 resulting from the compensation voltage Vc2 of the second voltage level. Consequently, the driving transistor DT is turned off by the voltage variation at the second node N2, thereby causing a black image to be displayed on the display panel 100 for the second period P2 of the each frame. In this case, in the second period P2 of the each frame, the direction of an electric field in the driving transistor DT is changed by the compensation voltage Vc2 of the second voltage level to reduce the amount of trap charge in the driving transistor DT, so as to prevent the hysteresis of the driving transistor DT from increasing.

Thereafter, the compensation voltage Vc1 of the first voltage level is supplied to the compensation voltage line CPL synchronously with the scan signal supplied to the first scan line SL1, so that each pixel cell 100 is driven in the same manner as in the first period P1 of the aforementioned frame.

As described above, according to the present invention, a black image is inserted for the second period P2 of each frame by raising the voltage at the second node N2 based on the compensation voltage Vc of the second voltage level. Therefore, it is possible to prevent the hysteresis of the driving transistor DT from increasing.

Furthermore, according to the present invention, the insertion of the black image can prevent a degradation in picture quality resulting from the hysteresis of the driving transistor DT without using additional circuits such as a switching element and/or memory and/or without increasing a frame frequency.

Figure 8:
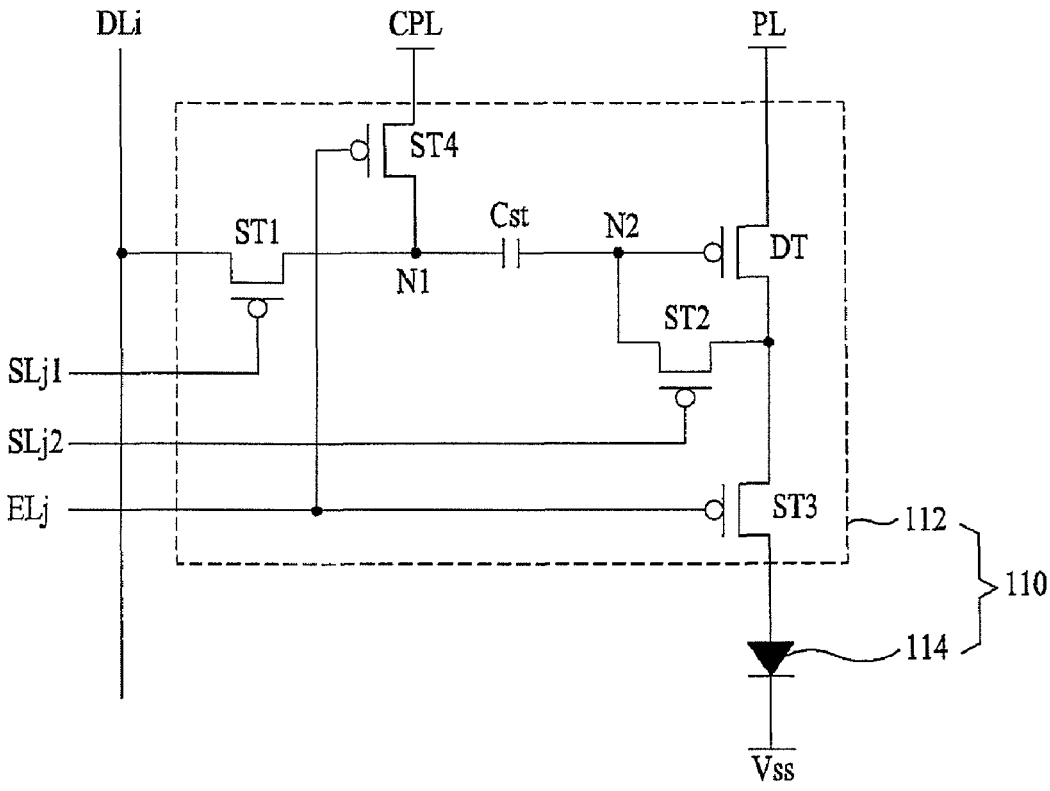
FIG. 8 is a circuit diagram showing an alternative pixel structure of the pixel cell according to the first embodiment of the present invention, shown in FIG. 4.

As shown in FIG. 8, in the light emitting display device according to the first embodiment of the present invention, the first and second switching elements ST1 and ST2 in each pixel cell 110 may be driven respectively by first and second scan signals supplied respectively from first and second scan lines SLj1 and SLj2 formed separately. At this time, the first and second scan signals have the same forms.

Figure 9:
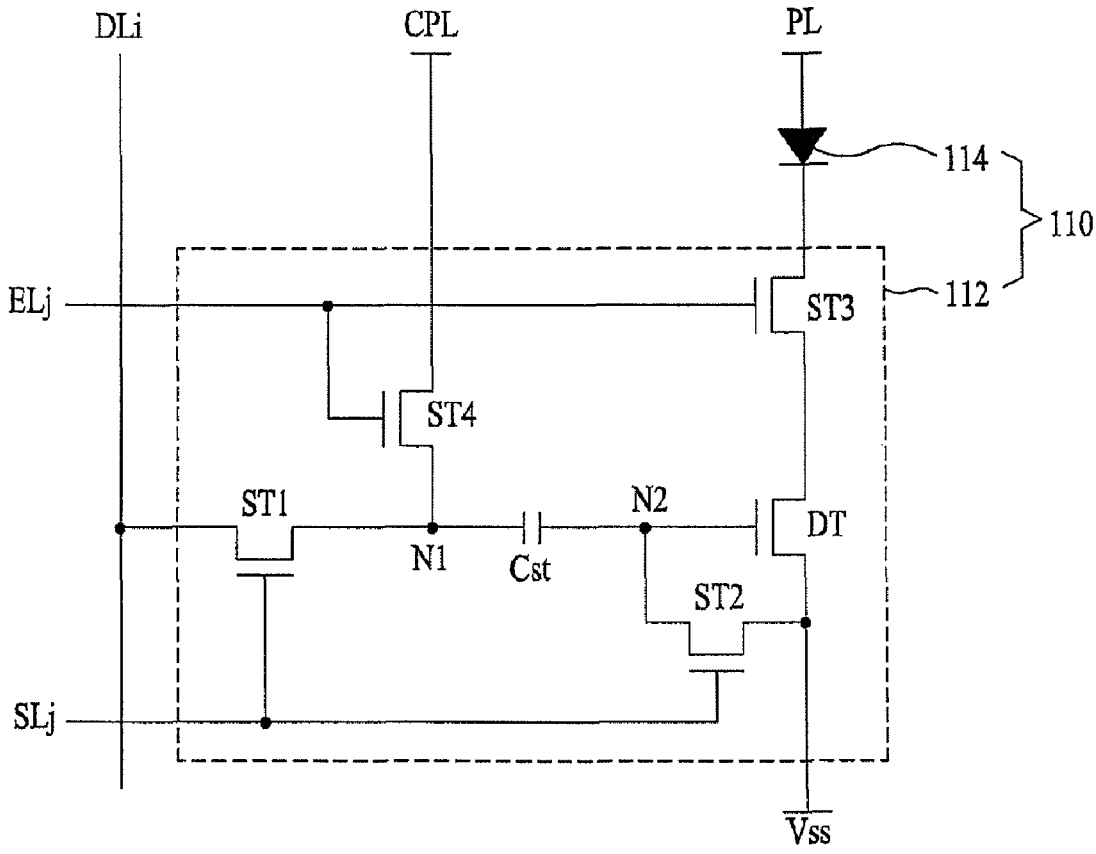
FIG. 9 is a circuit diagram showing a pixel structure of a pixel cell of a light emitting display device according to a second embodiment of the present invention.

FIG. 9 is a circuit diagram showing a pixel structure of a pixel cell of a light emitting display device according to a second embodiment of the present invention.

Referring to FIG. 9, the pixel cell of the light emitting display device according to the second embodiment of the present invention is the same in configuration as the above-stated pixel cell according to the first embodiment of the present invention, with the exception that first to fourth switching elements ST1 to ST4 and a driving transistor DT constituting a pixel circuit 112 are NMOS transistors.

Figure 10:
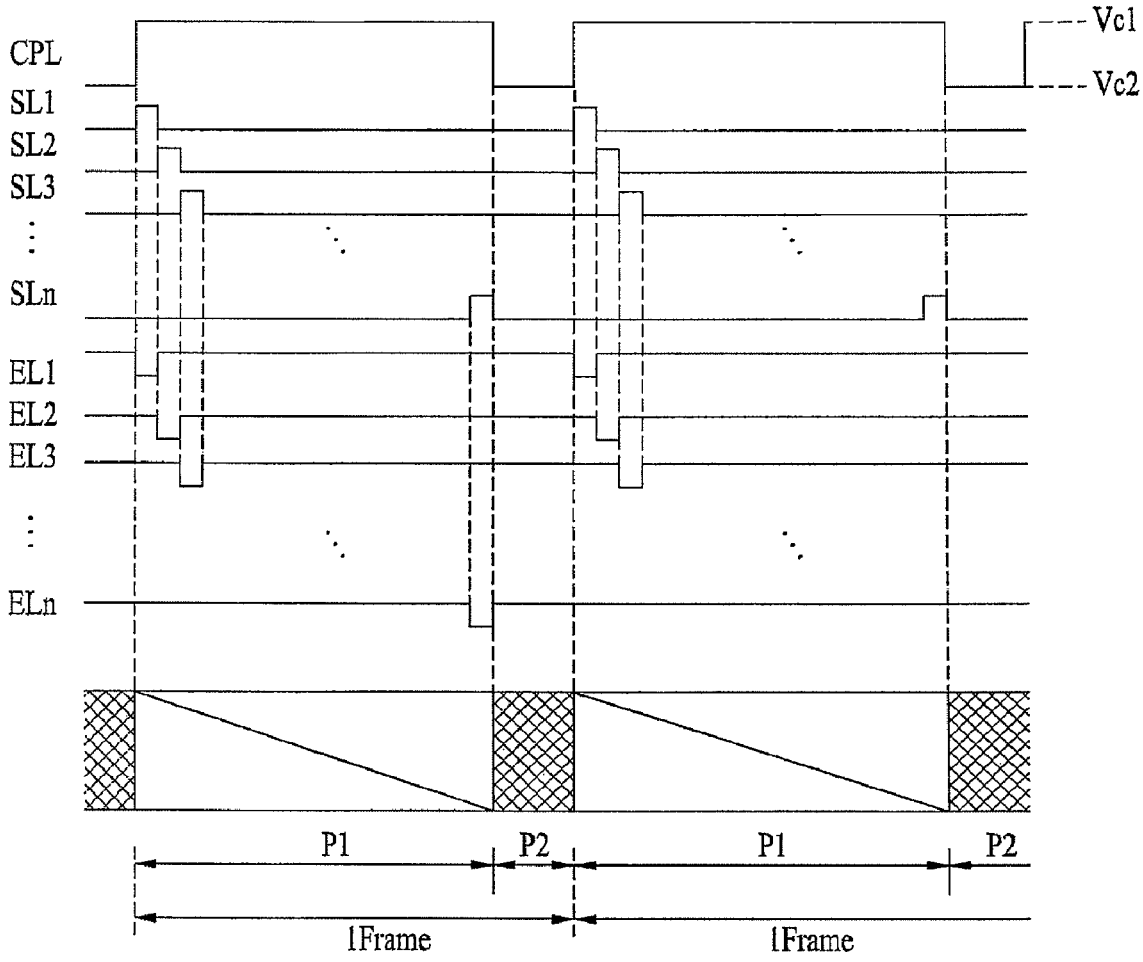
FIG. 10 is a driving waveform diagram of the light emitting display device according to the second embodiment of the present invention.

Also, as shown in FIG. 10, a scan signal and light emission control signal to drive the pixel circuit 112 have voltage levels to drive NMOS transistors. In addition, a compensation voltage Vc has a first voltage level Vc1 in a first period P1 of each frame and has a second voltage level Vc2 lower than the first voltage level Vc1 in a second period P2 of each frame.

This pixel cell of the light emitting display device according to the second embodiment of the present invention is driven in the same manner as the above-described pixel cell according to the first embodiment of the present invention based on NMOS transistor driving signals (a scan signal, light emission control signal, compensation voltage and driving voltage) to provide the same effect as that of the pixel cell according to the first embodiment of the present invention.

Figure 11:
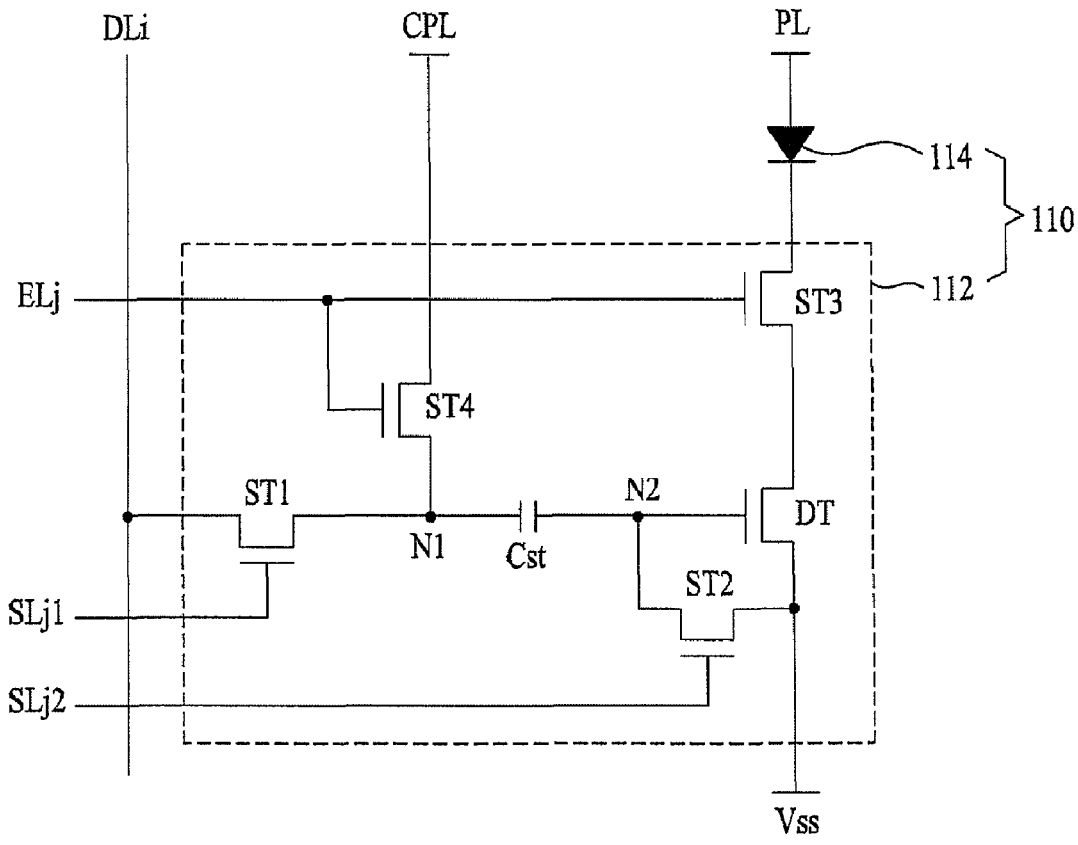
FIG. 11 is a circuit diagram showing an alternative pixel structure of the pixel cell of the light emitting display device according to the second embodiment of the present invention.

As shown in FIG. 11, in the light emitting display device according to the second embodiment of the present invention, the first and second switching elements ST1 and ST2 in each pixel cell 110 may be driven respectively by first and second scan signals supplied respectively from first and second scan lines SLj1 and SLj2 formed separately. At this time, the first and second scan signals have the same forms.

As apparent from the above description, in a light emitting display device and a driving method thereof according to the present invention, a compensation voltage of a first voltage level is used to compensate for a threshold voltage of a driving transistor for a first period of a frame so as to prevent picture quality from being degraded due to the threshold voltage, and a compensation voltage of a second voltage level is used to insert a black image for a second period of the frame to reduce hysteresis of the driving transistor, so as to prevent a degradation in picture quality.

Furthermore, according to the present invention, the insertion of the black image using the compensation voltage of the second voltage level can prevent a degradation in picture quality resulting from the hysteresis of the driving transistor without using additional circuits such as a switching element and/or memory and/or without increasing a frame frequency.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A light emitting display device comprising a pixel cell formed in an area defined by a data line supplied with a data voltage, at least one scan line supplied with a scan signal, a light emission control signal line supplied with a light emission control signal, a driving voltage line supplied with a driving voltage, and a compensation voltage line supplied with a compensation voltage of a first voltage level or a second voltage level different from the first voltage level, wherein the pixel cell comprises:

a light emitting element for emitting light by current; and a pixel circuit for providing current corresponding to the data voltage to the light emitting element using the data voltage, the scan signal, the light emission control signal, the driving voltage and the compensation voltage, wherein providing current corresponding to the data voltage to the light emitting element is based on the compensation voltage of the first voltage level and turning off the light emitting element is based on the compensation voltage of the second voltage level.

2. The light emitting display device according to claim 1, wherein the first voltage level is supplied in a first period of a frame and the second voltage level is supplied in a second period of the frame, the second period being a remaining period of the frame other than the first period.

3. The light emitting display device according to claim 2, wherein the compensation voltage of the second voltage level corresponds to a black data voltage.

4. The light emitting display device according to claim 3, wherein the first voltage level is the same as a level of the driving voltage.

5. The light emitting display device according to claim 2, wherein the pixel circuit comprises:

a driving transistor for providing current corresponding to a voltage at a gate electrode thereof to the light emitting element using the driving voltage;

a first switching element driven by the scan signal for supplying the data voltage to a first node;

a second switching element for connecting the gate electrode of the driving transistor to a source electrode or drain electrode of the driving transistor in response to the scan signal;

a third switching element for connecting the driving transistor with the light emitting element in response to the light emission control signal;

a fourth switching element for supplying the compensation voltage to the first node in response to the light emission control signal; and a capacitor connected between the first node and a second node, the second node being connected to the gate electrode of the driving transistor.

6. The light emitting display device according to claim 5, wherein:

the driving transistor is turned on for the first period by a voltage at the second node to provide current corresponding to a voltage difference between the data voltage and the compensation voltage of the first voltage level to the light emitting element; and the driving transistor is turned off for the second period by a voltage variation at the second node resulting from the compensation voltage of the second voltage level supplied to the first node.

7. A method for driving a light emitting display device, the light emitting display device including a pixel cell formed in an area defined by a data line supplied with a data voltage, at least one scan line supplied with a scan signal, a light emission control signal line supplied with a light emission control signal, a driving voltage line supplied with a driving voltage, and a compensation voltage line supplied with a compensation voltage, the method comprising:

supplying the compensation voltage of a first voltage level to the compensation voltage line;

outputting current corresponding to the data voltage based on the data voltage, the scan signal, the light emission control signal, the driving voltage and the compensation voltage of the first voltage level;

turning on a light emitting element by the current; and supplying the compensation voltage of a second voltage level different from the first voltage level to the compensation voltage line to turn off the light emitting element.

8. The method according to claim 7, wherein the first voltage level is supplied in a first period of a frame and the second voltage level is supplied in a second period of the frame, the second period being a remaining period of the frame other than the first period.

9. The method according to claim 8, wherein the compensation voltage of the second voltage level corresponds to a black data voltage.

10. The method according to claim 9, wherein the first voltage level is the same as a level of the driving voltage.

11. The method according to claim 8, wherein the step of outputting the current corresponding to the data voltage comprises:

a) supplying the data voltage to a first node through a first switching element turned on by the scan signal and, at the same time, connecting a gate electrode of a driving transistor to a source electrode or drain electrode of the driving transistor through a second switching element turned on by the scan signal to sample a threshold voltage of the driving transistor at a second node;

b) connecting the driving transistor with the light emitting element through a third switching element turned on by the light emission control signal and, at the same time, supplying the compensation voltage of the first voltage level to the first node through a fourth switching element turned on by the light emission control signal; and c) turning on the driving transistor based on a voltage at the second node varying by a voltage variation at the first node by a capacitor connected between the first node and the second node to output the current.

12. The method according to claim 11, wherein the step of turning off the light emitting element comprises:

supplying the compensation voltage of the second voltage level instead of the compensation voltage of the first voltage level at the step b); and turning off the driving transistor based on a voltage at the second node varying by a voltage variation at the first node resulting from the compensation voltage of the second voltage level by the capacitor to turn off the light emitting element.

* * * * *